United States Patent [19]

Bauer

[11] 3,955,945

[45] May 11, 1976

[54] OIL SEPARATOR FOR AIR COMPRESSORS AND THE LIKE

[76] Inventor: Heinz Bauer, Katharinenstr. 10, 8 Munich 71, Germany

[22] Filed: July 16, 1973

[21] Appl. No.: 379,328

[30] Foreign Application Priority Data

July 14, 1972 Austria ..... 6108/72

[52] U.S. Cl. ..... 55/159; 55/185; 55/319

[51] Int. Cl.[2] ..... B01D 19/00; B01D 50/00

[58] Field of Search ..... 55/46, 55, 97, 159, 55/183, 185, 259, 319–321, 464–468

[56] References Cited

UNITED STATES PATENTS

| | | | |
|---|---|---|---|
| 3,273,313 | 9/1966 | Livesy et al. | 55/46 |
| 3,364,658 | 1/1968 | Walker | 55/171 |
| 3,540,190 | 11/1970 | Brink, Jr. | 55/97 |
| 3,708,959 | 1/1973 | Soumerai | 55/97 |
| 3,791,105 | 2/1974 | Rhodes | 55/97 |

*Primary Examiner*—Charles N. Hart
*Assistant Examiner*—Richard W. Burks
*Attorney, Agent, or Firm*—Karl F. Ross; Herbert Dubno

[57] ABSTRACT

An oil separator in the output of an air compressor comprises a housing to which a mixture of compressed air and entrained oil is supplied through an inlet port which opens toward a separation unit removably inserted into the housing. The separation unit, comprising one or more filters adjoining an outlet port for the purified air, has a drain provided with an extractor for the forced exhaustion of oil retained in that unit; the extractor carried by the filter unit may be a nozzle, with an orifice that opens into the fluid flow issuing from the inlet port, or a pump whose impeller is driven by that fluid flow either upstream or downstream of the separation unit.

16 Claims, 13 Drawing Figures

OIL SEPARATOR FOR AIR COMPRESSORS AND THE LIKE

FIELD OF THE INVENTION

My present invention relates to an oil separator as employed in conjunction with a compressor for air or other gas, using oil as a lubricant, sealer and/or coolant, for the purpose of removing entrained oil from the flow of gas under pressure and returning that oil to the compressor for re-use.

BACKGROUND OF THE INVENTION

It is known to design such an oil separator as a housing with a removable separation unit or filter cartridge inserted therein, this unit including one or more filters to be traversed by the flow of gas admixed with oil. The heavier oil particles do not reach the filter assembly but are separated ahead of the cartridge from the upwardly or horizontally flowing gas stream; the remainder of the oil coalesces along the downstream surfaces of the filter elements and accumulates at the bottom of the cartridge while the purified gas flow exists through an outlet port thereof. Because of the pressure differential (e.g. of 300 mm water column or more) that must be maintained in order to drive the gas glow through the filter, the oil accumulating inside the cartridge cannot be simply discharged into the housing for return to the compressor along with the initially separated oil. The expedient of connecting the sump of the cartridge with the oil pool of the housing by way of a constricted drain is unsatisfactory inasmuch as the constriction, if wide enough to give passage to the relatively viscous cold oil during the starting-up period, will subsequently allow a substantial quantity of compressed gas to return along with the oil from the interior of the cartridge to the compressor intake with resulting diminution of the efficiency of the system. Attempts to eliminate the need for such a throttled return through the generation of a positive driving force, designed to overcome the aforementioned pressure differential, have heretofore involved relatively complicated structures which make the device difficult to assemble and service.

OBJECTS OF THE INVENTION

The general object of my present invention, therefore, is to provide an improved oil separator avoiding the aforestated drawbacks.

A more specific object is to provide simple and effective means in such an oil separator for returning the filtered-out oil to the mainstream of compressor lubricant in a controlled manner and without wasteful recirculation of air or other working gas.

SUMMARY OF THE INVENTION

The foregoing objects are realized, in conformity with my present invention, by providing the separation unit or cartridge with an extractor for forcibly exhausting the separated oil to the interior of the separator housing, this extractor communicating with the drain of the unit and having a driving element freely supported on the unit in the path of the gas flow for actuation thereby.

The extractor according to my present invention could be either of the passive or of the active type. In the first instance it comprises a conduit provided at its free end with a nozzle head serving as its driving element, this nozzle head having one or more orifices which open into the gas flow within the inlet port of the separator housing; the orifice or orifices are advantageously located at a constriction defined by a midportion thereof with the surrounding inlet port, thereby opening into a region of maximum flow velocity, the ends of the nozzle head tapering on opposite sides of this midportion so as to give it a generally streamlined configuration for a minimum flow resistance. In the second instance the extractor comprises an oil pump whose driving element is an impeller of axial, radial or mixed type; this impeller may be disposed either upstream or downstream of the filter means of the separation unit, i.e. at the inlet port of the separator housing or at the outlet port of the unit. Placing the impeller in or close to the inlet port affords maximum utilization of the available driving energy from the gas flow emitted by the compressor; on the other hand, positioning the impeller downstream of the filter assembly protects it against contamination by the entrained oil.

In the case of a vertical separation unit, in which the collected oil accumulates in a sump within a well formeo at the bottom of the filter casing, the intake end of the pump can be directly secured to this well at the lowest point thereof. In the case of a horizontal unit with several spacedly juxtaposed parallel vertical filter layers, as frequently used in mobile oil separators, the pump may have an intake duct communicating with a plurality of wells respectively located near the bottoms of these layers. If the pump and its impeller are located at opposite ends of the separation unit, they may be interconnected by a shaft with a separable coupling to facilitate assembly and disassembly.

Unless the extractor comprises a positively acting pump (e.g. of peristaltic or gear type). a sudden depressurization of the inlet port upon a stopping of the compressor may create a condition in which dispersed oil particles within the atmosphere of the separator housing would be free to return to the drain of the separation unit and thence to pass into the outlet port thereof. This can be avoided, pursuant to another feature of my invention, by providing the active or passive extractor with check-valve means such as, for example, a flexible skirt surrounding the aforementioned nozzle head.

A particularly effective and simple nonpositively acting pump, to be utilized as an extractor in a system according by my invention, has a hollow shaft through which one or more open-end laterally extending nozzles communicate with the drain of the separation unit. Rotation of these nozzles about the shaft axis centrifugally accelerates the oil entering the shaft bore.

BRIEF DESCRIPTION OF THE DRAWING

The above and other features of my invention will now be described in detail with reference to the accompanying drawing in which.

SPECIFIC DESCRIPTION

Figure 1:
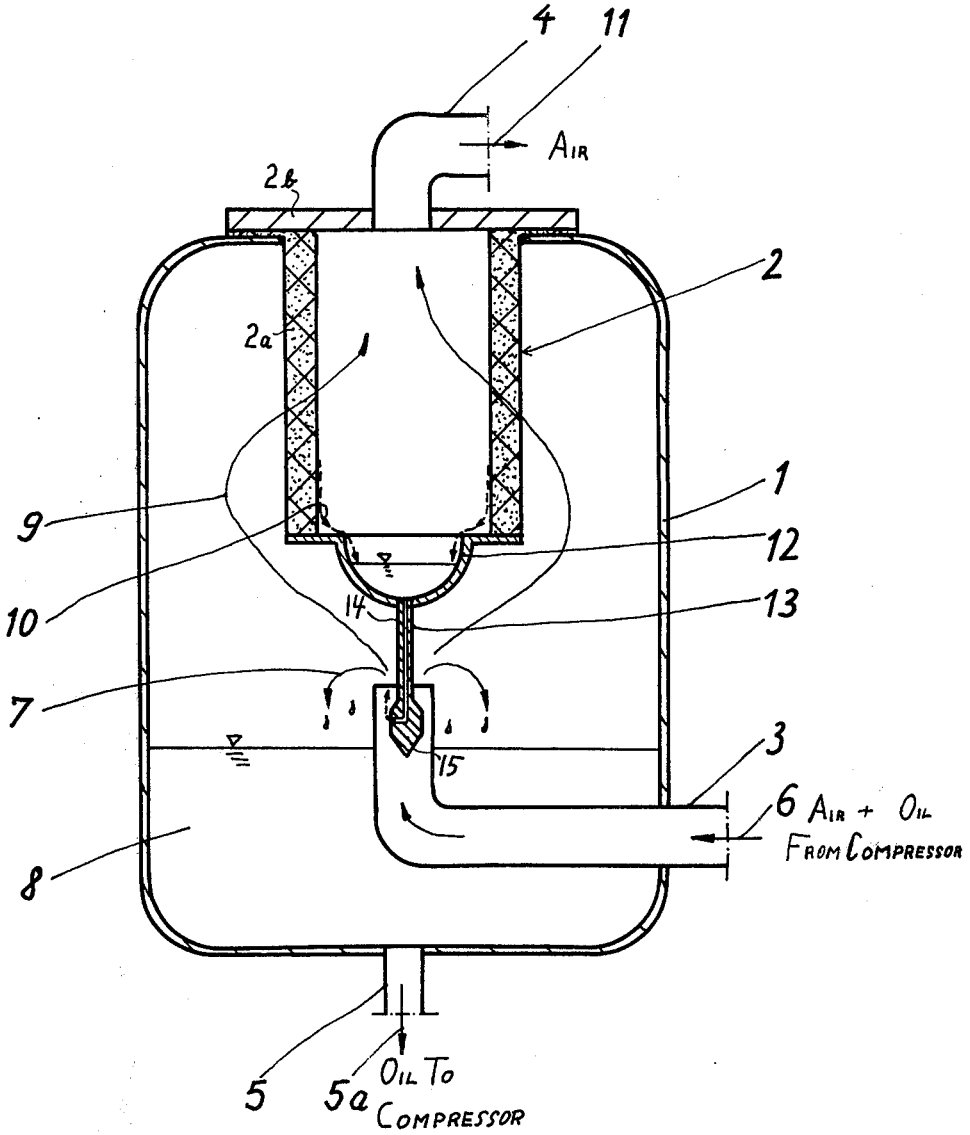
FIG. 1 is a sectional elevational view of an upright oil separator embodying my invention.

In FIG. 1 I have shown an oil separator according to my invention, comprising a pressure-resistant cylindrical housing 1, a separation unit 2 in the form of a removable cartridge centered on the housing axis, an inlet port 3 receiving a flow of gas (here air) delivered together with entrained oil by a nonillustrated compressor as indicated by an arrow 6, and a discharge port 5 for oil separated from that flow for return to the compressor, after cooling and filtering, as indicated by an arrow 5*a*. Unit 2 comprises a casing whose cylindrical peripheral wall 2*a* is constituted by conventional filter material (e.g. glass wool) and whose bottom forms a well 12 designed to collect the runoff of oil coalescing along the inner surface of filter element 2*a*, as indicated by arrows 10.

Inlet port 3 is constituted by an elbow-shaped conduit which opens upwardly towards the bottom of well 12, allowing the heavier droplets of entrained oil to leave the incoming flow 6 and collect in a pool 8 at the bottom of the housing as indicated by arrows 7. The remainder of the flow then passes into the interior of unit 2 through the filter 2*a* thereof and, after purification, reaches the outlet port 4 as clean air under pressure to be delivered (arrow 11) to a nonillustrated destination.

Figure 2:
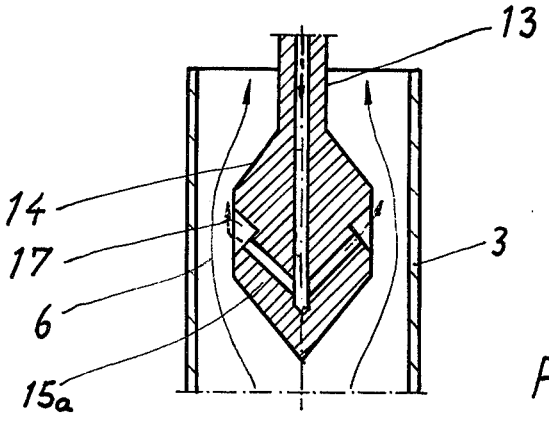
FIGS. 2, 3 and 4 are enlarged detail views, in axial section, of different configurations of a nozzle head forming part of the separator of FIG. 1.
Figure 3:
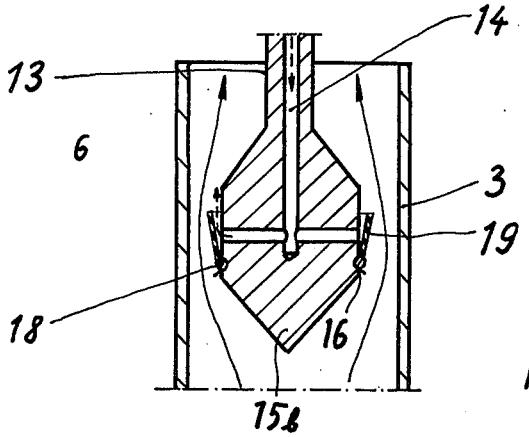

The hemispherical well 12 is provided at its nadir with a drain hole into which an extractor is fitted, this extractor consisting of a depending tube 13 terminating at its free lower end in a nozzle 15 which is spacedly surrounded by the vertical branch of elbow 3. The bore 14 of tube 13 is angularly bent within nozzle 15 so as to open into a constricted zone of the inlet port defined by a midportion of this head bracketed between tapering upper and lower extremities. The rush of compressed air past the discharge end or nozzle orifice of bore 14 creates a Venturi effect which helps draw out the oil from the sump in well 12 so that this oil, too, is directed into the pool 8 as indicated by arrows 7. Actually, the end of bore 14 should be somewhat recessed to facilitate generation of the necessary underpressure, e.g. as shown in FIGS. 2 and 3 described hereinafter. The short horizontal branch of bore 14 may be duplicated along the periphery of head 15 so as to provide two or more nozzle orifices for the discharge of the collected oil from unit 2.

Thus, the extractor 13–15 is comparable to a jet pump and is subjected to a driving force which (altogether with the force of gravity acting upon the oil in well 12 and bore 14) overcomes the pressure drop existing between the outer and inner peripheral surfaces of filter element 2*a*. Through suitable proportioning of the system parameters this driving force may be so chosen that the pressure differential created thereby across filter 2*a* compensates the aforementioned pressure drop to an extent allowing only a partial draining of well 12 so that a residue of oil always remains in pipe 13, thereby preventing a wasteful recirculation of compressed air from the interior of unit 2 to the associated compressor.

The casing of unit 2 forms a flange 2*b* which overlies the top of housing 1 and may be removably fastened thereto by screws not shown. Upon unscrewing, the entire unit with its extractor 13–15 can be bodily withdrawn from the housing, e.g. for replacement of its filter 2*a*; the remainder of the assembly, and in particular the connection between housing 1 and the compressor, is not affected by this action.

FIG. 2 depicts a nozzle head 15*a* formed with peripheral undercuts 17 at the end of the lateral branches of bore 14 which in this instance are shown inclined at an acute angle with reference to the flow 6.

In FIG. 3 I have shown a nozzle head 15*b* provided near its lower (upstream) end with a peripheral shoulder 16 above which the lateral branches of bore 14 extend horizontally, as in FIG. 1, thus at right angles to the flow 6. The nozzle orifices defined by these branches are surrounded by a resilient skirt 19, such as an annular rubber membrane, held in position on shoulder 16 by a wire clip 18 which acts as a check valve to prevent any return of oil to the interior of unit 2 in the event that the associated air compressor is of a type designed to vent the inlet port 3 to the atmosphere upon being stopped. Skirt 19 is sufficiently flexible to place only a negligible flow resistance in the path of the entering oil during operation of the compressor. Naturally, such a skirt or equivalent check-valve means could also be provided on the nozzle head 15*a* of FIG. 2.

Figure 4:
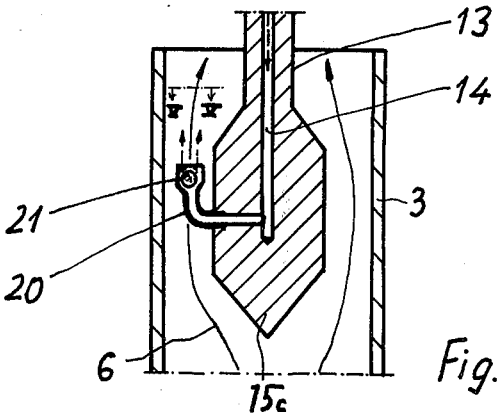
Figure 5:
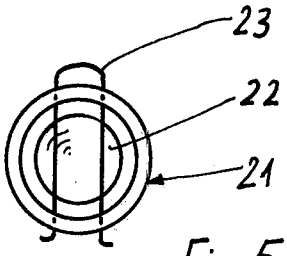
FIG. 5 is a top view, drawn to a still larger scale, of a detail of the assembly of FIG. 4 as seen on the line V—V thereof.

In FIG. 4 I have illlustrated a further nozzle head 15*c*, narrower than heads 15*a* and 15*b* with reference to the surrounding conduit 3, which carries a tubular elbow 20 communicating with the nozzle orifices of bore 14; elbow 20, whose internai diameter is the same as that of the adjoining bore branch, terminates in a socket 21 (see also FIG. 5) which opens in the downstream direction of flow 6 — i.e. upwardly — and contains a ball check 22 held in position by a hairpin clip 23.

Figure 6:
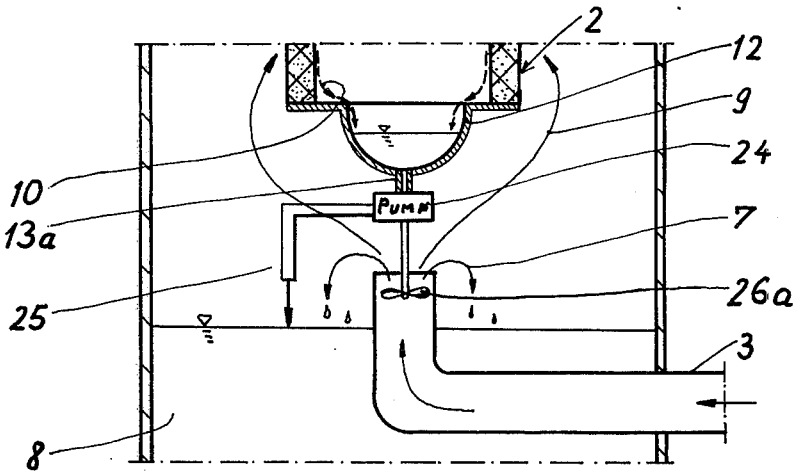
FIGS. 6–8 are views similar to part of FIG. 1, illustrating other embodiments of my invention.

The embodiment of FIG. 6 utilizes an active extractor, comprising a pump 24 driven by an impeller 26*a*, in lieu of the passive extractor 13–15 of FIG. 1. Pump 24 has an intake end 13*a*, inserted into the drain hole of well 12, and a discharge duct 25 for delivering the extracted oil to the pool 8. Again, the capacity of the pump may be so chosen that its action balances the pressure drop across filter 2*a* to the extent necessary for partial drainage of the well 12 as described above.

Figure 7:
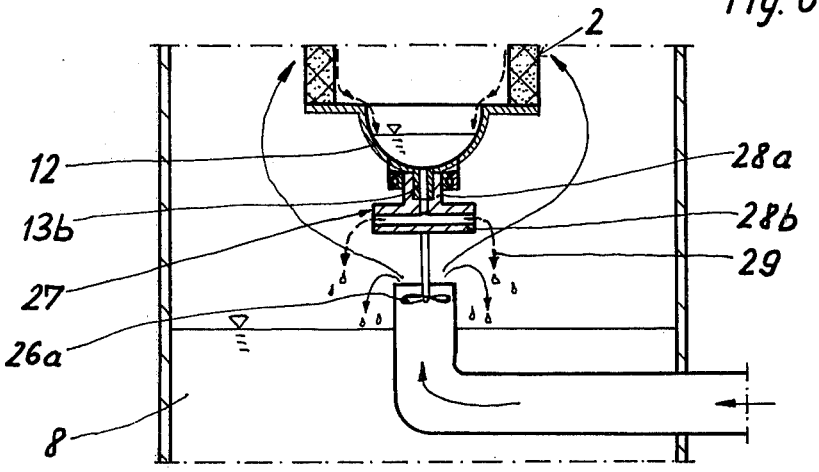

In FIG. 7 the conventional (e.g. peristaltic) pump 24 of FIG. 6 has been replaced by a centrifugal pump 27 having a tubular shaft 28*a* journaled on a trunnion 13*b* which is fixedly mounted in the drain hole of well 12. Shaft 28*a* is integral with a transverse tube 28*b* defining therewith a conduit of inverted-T shape. The open ends of tube 28*b* serve for the centrifugal ejection of the oil as indicated by arrows 29.

Figure 8:
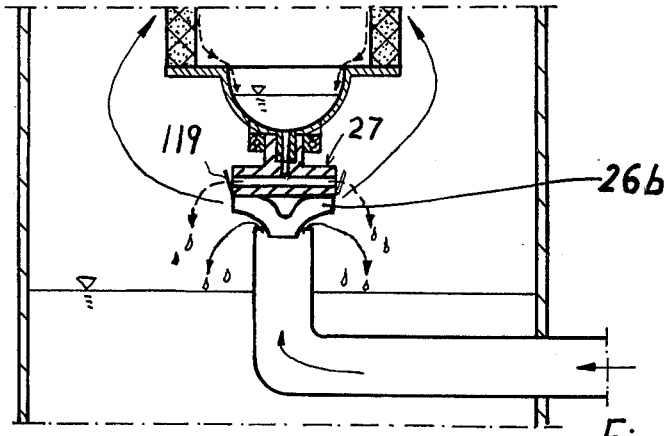

Whereas in FIGS. 6 and 7 the pump is provided with an impeller 26*a* having vanes acted upon by an axial flow in elbow 3, I have shown in FIG. 8 an impeller 26*b* whose vanes are directly mounted on the pump 27 and are curved for actuation by a radial component of the flow exiting from that elbow. Furthermore, FIG. 8 also shows flaps 119 acting as check valves, as described with reference to the skirt 19 of FIG. 3, to prevent the return of oil to the interior of unit 2 upon a sudden depressurization with certain compressor designs; such flaps could, of course, also be used in the system of FIG. 7.

Figure 9:
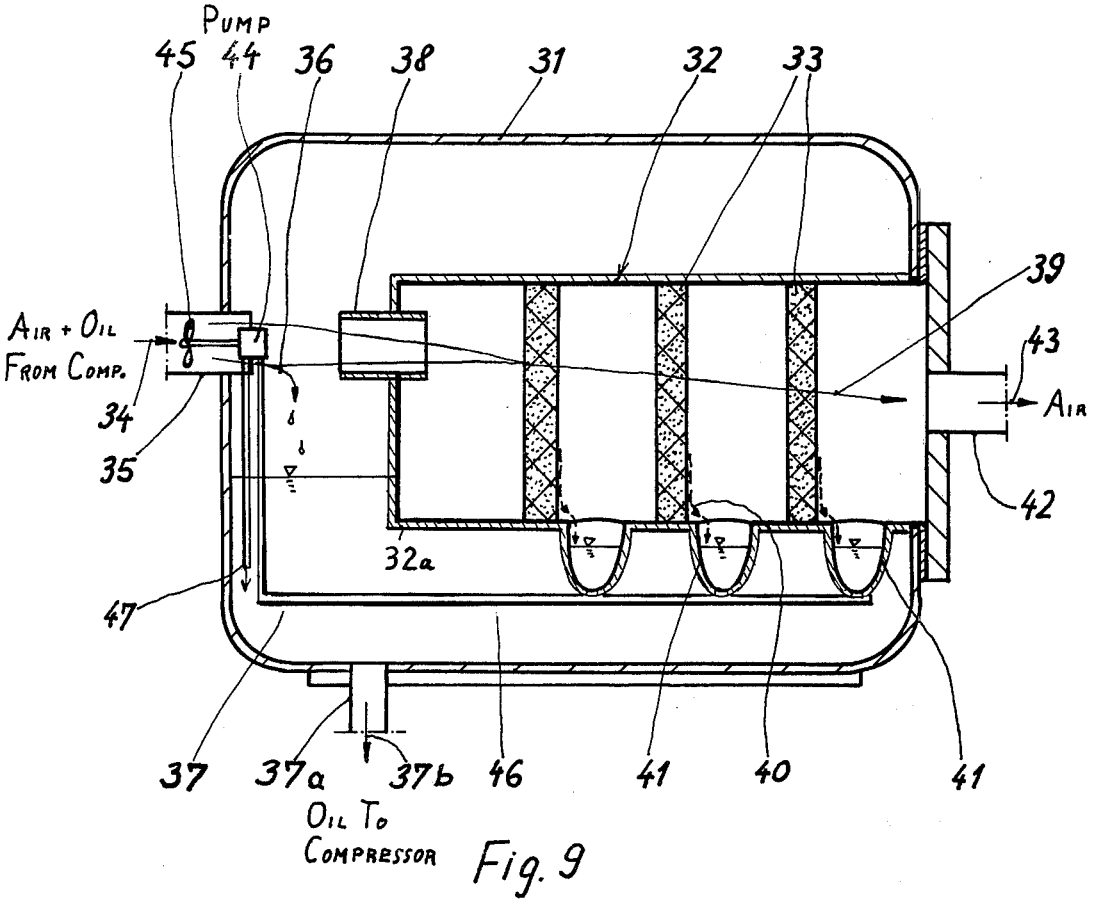
FIG. 9 is a longitudinal sectional view of a horizontal separator embodying my invention.

The oil separator shown in FIG. 9, which may be of the mobile type, has a housing 31 centered on a horizontal axis, an inlet port 35 for the admission of a compressed air/oil mixture (arrow 34) and a discharge port 37*a* for the return of collected oil from a pool 37 to the associated compressor by way of nonillustrated cooling and filtering devices (arrow 37*b*). A separation unit or cartridge 32 is again centered on the cylinder axis and is removably inserted into the housing 31, this unit comprising several parallel, axially spaced vertical filter layers 33 in the path of an air flow 39 entering the cartridge through a short tube 38 in line with port 35.

Cartridge 32 has a casing 32*a* forming several wells 41 near the bottom of the respective filter layers 33 on the downstream side thereof; as in the case of the vertical cartridge shown in preceding Figures, the oil particles removed from the air coalesce on these filter surfaces and then pass (arrows 40) into the wells which are provided with drain holes opening into an intake duct 46 of a conventional pump 44. The pump, which may again be of the peristaltic type, is also physically supported by the duct 46 and in turn carries an impeller 45 received within inlet port 35; a discharge duct 47 of pump 44 extends downwardly into the pool 37.

The operation of the system of FIG. 9 is analogous to that of the oil separator shown in FIG. 6; the larger oil particles are removed from the oil flow 39 by gravity ahead of the cartridge 32 as indicated by an arrow 36. In this case, as well as in the subsequently described embodiments, the pump could also be of the centrifugal type illustrated in FIGS. 7 and 8.

Figure 10:
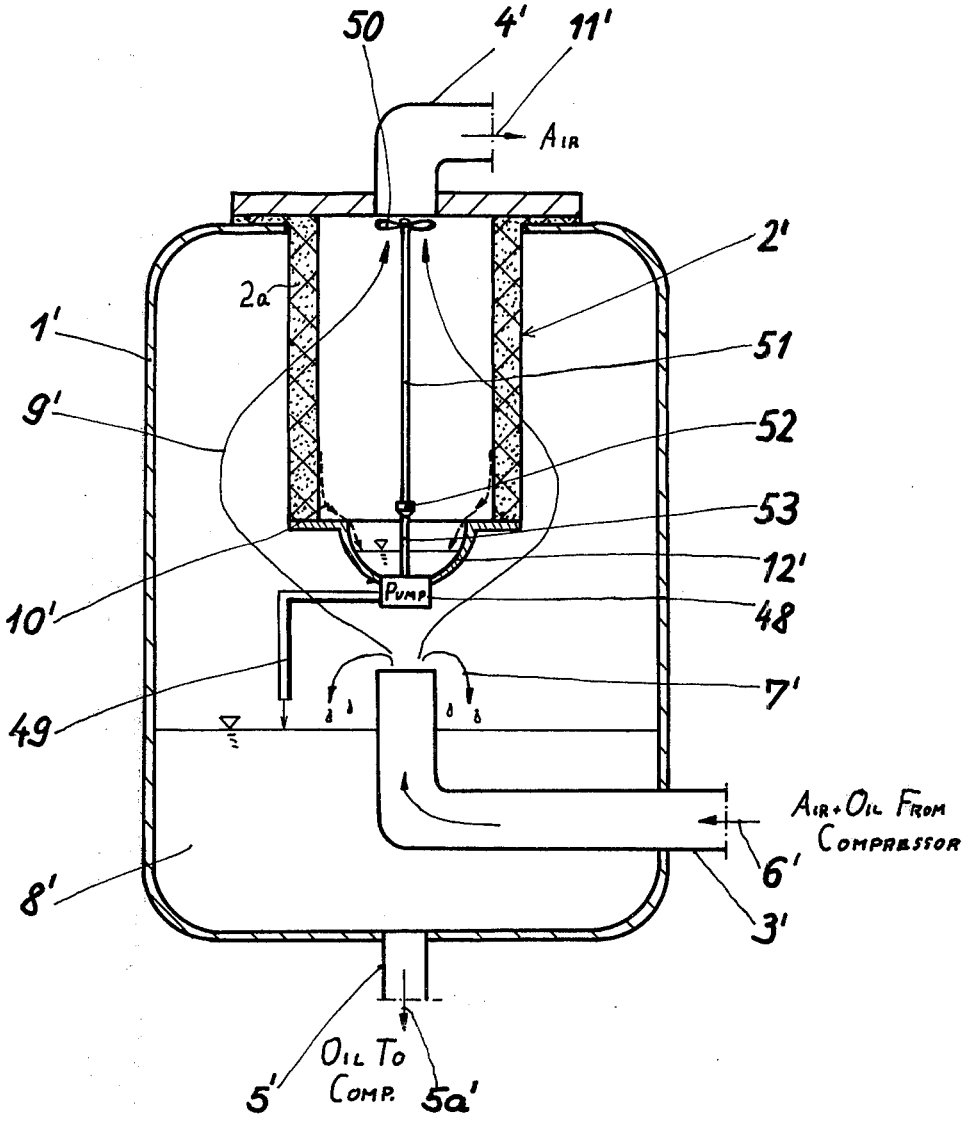
FIG. 10 is a view similar to FIG. 1, illustrating a modification of the embodiment of FIG. 6.

FIG. 10 shows an oil separator generally similar to that of FIGS. 1 and 6, with corresponding elements designated by the same reference numerals supplemented by a prime mark. Pump 24 has been replaced, however, by a similar pump 48 whose impeller 50 is disposed at the entrance of the outlet port 4' of cartridge 2', this impeller having a shaft 51 with an extension 53 detachably connected therewith via a splined coupling 52. Thus, impeller 50 is driven only by the flow 9' of purified air which has passed through the filter 2*a* and whose pressure is therefore reduced with reference to the pressure acting upon impeller 26*a* of FIG. 6 or 7.

Figure 11:
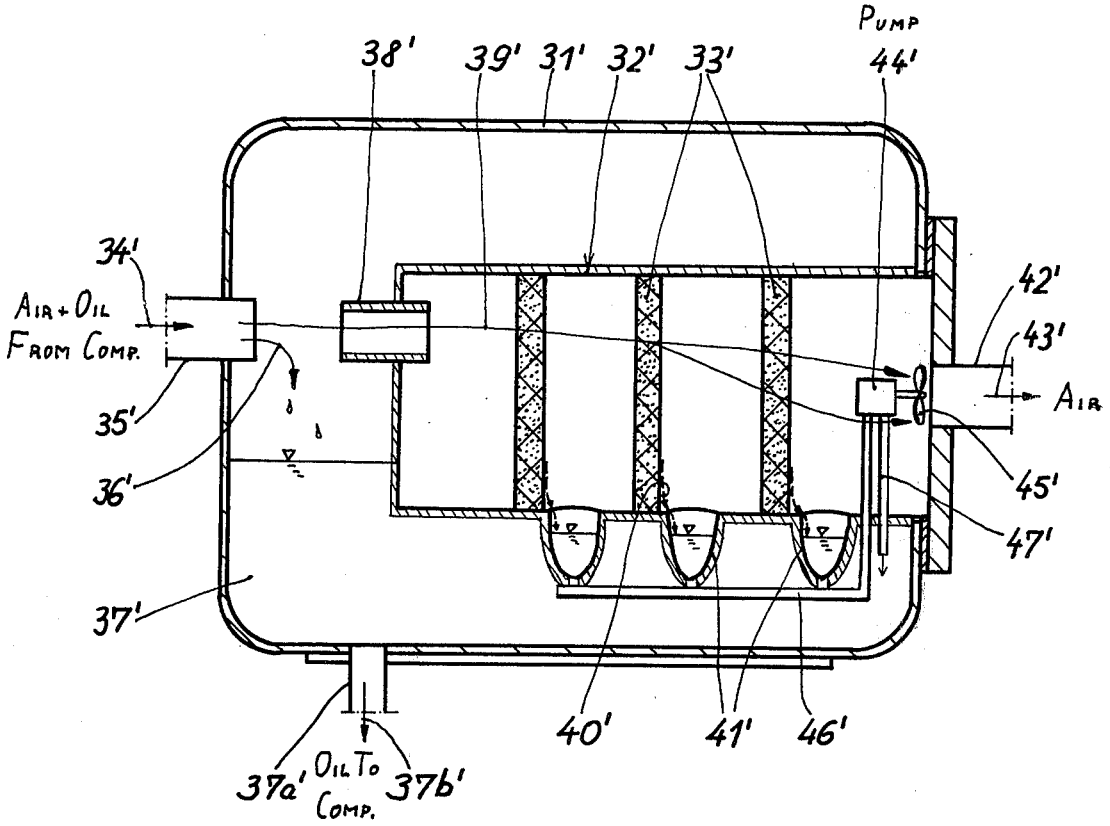
FIG. 11 is a view similar to FIG. 9, showing another modification.

In FIG. 11 I have shown a modification of the system of FIG. 9, with analogous elements again designated by similar reference numerals supplemented by a prime mark. Pump 44' is here supported, by its intake duct 46', within cartridge 32' just in front of outlet port 42' at whose entrance the impeller 45' is disposed in a manner analogous to that of FIG. 10.

Figure 12:
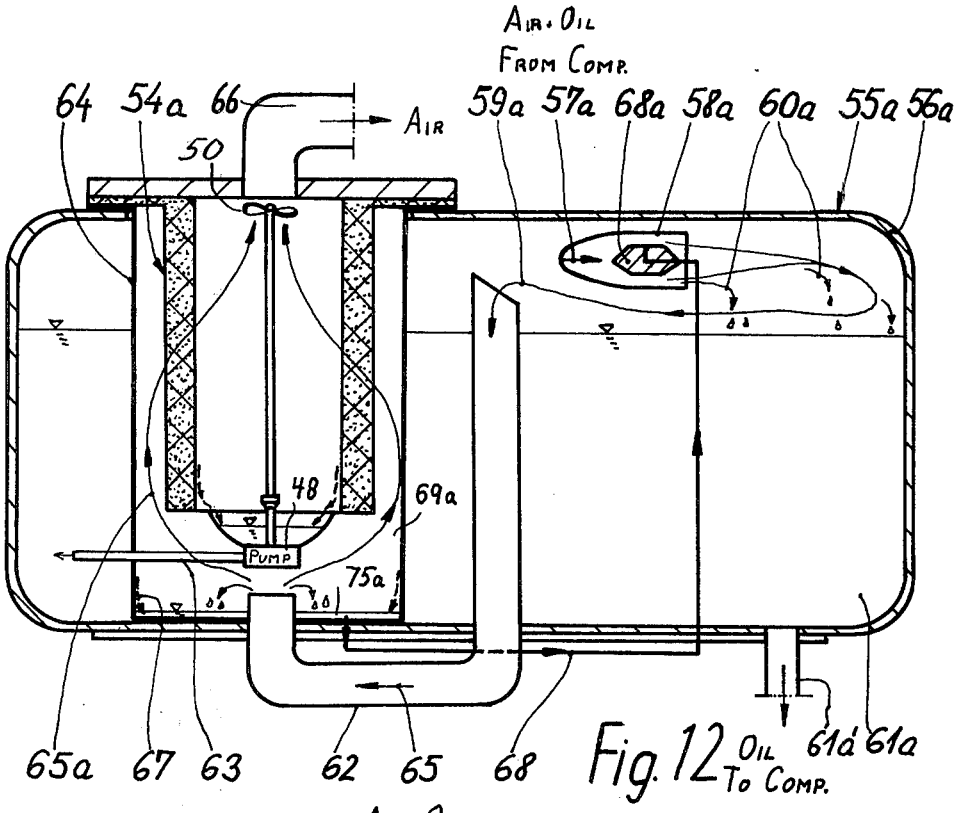
FIGS. 12 and 13 are longitudinal sectional views of further developments of the oil separator shown in FIG. 10.

FIG. 12 illustrates a more elaborate oil separator 55*a* operating in two phases, this separator comprising a generally cylindrical, horizontally disposed outer vessel 56*a* into which an air/oil mixture from an associated compressor is admitted (arrow 57*a*) via one or more conduits 58*a* extending skew to the cylinder axis. The coarser oil particles are immediately discharged into a pool 61*a*, as indicated by arrows 60*a*, whereas the remainder of the flow enters a J-shaped conduit 62 (arrow 59*a*) in which it passes (arrow 65) into a cylindrical inner housing 64 centered on a vertical axis. Housing 64 contains a removable cartridge 54*a* which is similar to cartridge 2' of FIG. 10 and, like the latter, is equipped with a pump 48 and an impeller 50 therefor, the latter confronting the entrance of an outlet port 66 through which the purified air escapes. Pump 48 has a discharge duct 63 which opens into the pool 61*a* surrounding the vessel 64; a similar, smaller pool 75*a* is formed in the interior 69*a* of housing 64 from oil leaving the air flow 65*a* before its impingement upon cartridge 54*a*. The oil thus accumulated within the housing 64 is aspirated, via a conduit 68, by a nozzle head 68*a* subjected to the Venturi effect of the incoming flow 57*a* within duct 58*a*, in the manner described with reference to FIG. 1. All the separated oil is returned to the compressor via a discharge port 61*a'* on the bottom of vessel 55*a*.

Figure 13:
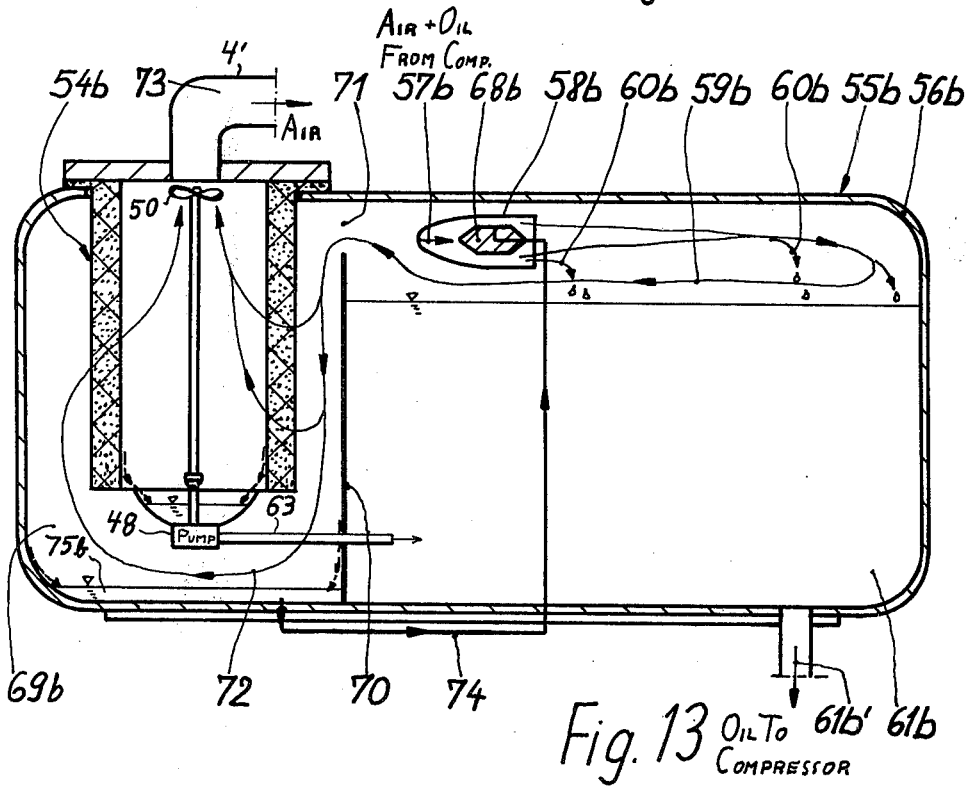

The system of FIG. 13 is generally similar to that of FIG. 12, with corresponding elements designated by the same reference numerals followed by the postscript *b* in lieu of *a*. In this instance the upright cylinder 64 has been replaced by a vertical partition 70 separating the pool 61*b* in vessel 55*b* from the smaller pool 75*b* in a compartment 69*b* containing the cartridge 54*b*. The incoming airflow, freed from its coarser oil particles at 60*b*, passes (arrow 59*b*) through a gap 71 above partition 70 into the compartment 69*b* and tranverses the filter of cartridge 54*b* as indicated at 72, exiting through a discharge port 73. The oil from pool 75*b* is aspirated through a conduit 74 by nozzle head 68*b* within supply duct 58*b*.

If desired, the discharge duct 63 shown in FIGS. 12 and 13 may be foreshortened so as to let the oil from the interior of cartridge 54*a* or 54*b* drop into the pool 75*a* or 75*b* from which it can be exhausted into the oil volume 61*a* or 61*b* by way of tube 68 or 74 and nozzle head 68*a* or 68*b*.

An ancillary oil compartment as shown at 69*a* and 69*b* in FIGS. 12 and 13 exists, in fact, also in the systems of FIGS. 9 and 11, to the left of the first filter layer 33 or 33' within unit 32 or 32'. Any oil accumulating in this compartment could also be evacuated by an ancillary extractor similar to that shown at 68*a* or 68*b*.

It will be apparent that the filter cartridges according to my invention can be simply and inexpensively installed in pre-existing oil separators of conventional design.

I claim:

1. An oil separator for returning entrained oil to a compressor delivering a flow of gas under pressure, comprising:

a housing provided with an inlet port connectable to the compressor output for receiving its gas flow, said housing being provided with a discharge port for oil to be returned to the compressor:

a separation unit removably inserted into said housing at a location above said discharge port and provided with filter means in the path of said gas flow, said unit having an outlet port for purified gas and further having a drain for oil separated from said gas; and an extractor on said unit in direct communication with said drain for forcedly exhausting the separated oil to the interior of said housing with creation of a pressure differential across said filter means to promote the penetration thereof by said gas flow, said extractor having a driving element freely supported on said unit in the path of said gas flow for actuation thereby.

2. An oil separator as defined in claim 1 wherein said extractor comprises a conduit extending outwardly from said drain, said driving element being a nozzle head at a free end of said conduit having an orifice opening into said gas flow within said inlet port.

3. An oil separator as defined in claim 2 wherein said nozzle head is provided with check-valve means overlying said orifice for preventing a return of extracted oil to said drain.

4. An oil separator as defined in claim 3 wherein said orifice opens onto a generally cylindrical peripheral surface of said nozzle head, said check-valve means comprising a resilient skirt surrounding said peripheral surface.

5. An oil separator as defined in claim 3 wherein said check-valve means comprises a ball check.

6. An oil separator as defined in claim 5 wherein said orifice terminates in a socket for said ball check open in the downstream direction of said gas flow.

7. An oil separator as defined in claim 2 wherein said nozzle head is provided with tapering upstream and downstream ends, said orifice being located at a constriction defined by said inlet port and by a midportion of said nozzle head between said ends.

8. An oil separator as defined in claim 1 wherein said extractor comprises an oil pump, said driving element being an impeller for said pump.

9. An oil separator as defined in claim 8 wherein said pump has a hollow rotatable shaft and at least one open-ended laterally extending nozzle on said shaft communicating with said drain through said shaft.

10. An oil separator as defined in claim 9 wherein said nozzle is provided with check-valve means at the open end thereof.

11. An oil separator as defined in claim 8 wherein said impeller is disposed at said inlet port for actuation by the gas flow upstream of said filter means.

12. An oil separator as defined in claim 8 wherein said impeller is disposed at said outlet port for actuation by the gas flow downstream of said filter means.

13. An oil separator as defined in claim 8 wherein said filter means is in the shape of an upright cylinder, said drain comprising a well at the lower end of said cylinder, said pump having an intake end directly secured to said well at the lowest point thereof.

14. An oil separator as defined in claim 8 wherein said filter means is in the shape of several spacedly juxtaposed vertical layers, said drain comprising a plurality of wells near the bottoms of said layers, said pump being provided with an intake duct communicating with all said wells in parallel.

15. An oil separator as defined in claim 8 wherein said pump is disposed at one end of said unit and said impeller is disposed at the opposite end of said unit, further comprising a shaft with a separable coupling interconnecting said pump and said impeller.

16. An oil separator as defined in claim 1 wherein said driving element is disposed at said outlet port for actuation by the gas flow downstream of said filter means, said housing being subdivided into a first compartment provided with said inlet and discharge ports and a second compartment containing said unit, further comprising ancillary extractor means responsive to the gas flow in said inlet port for transferring separated oil from said second compartment to said first compartment.

* * * * *